US011828059B2

(12) United States Patent
Klein

(10) Patent No.: US 11,828,059 B2
(45) Date of Patent: Nov. 28, 2023

(54) DEPLOYABLE INDOOR SHELTER

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 17/287,021

(22) PCT Filed: Oct. 25, 2019

(86) PCT No.: PCT/IB2019/059159
§ 371 (c)(1),
(2) Date: Apr. 20, 2021

(87) PCT Pub. No.: WO2020/084579
PCT Pub. Date: Apr. 30, 2020

(65) Prior Publication Data

US 2021/0388600 A1 Dec. 16, 2021

Related U.S. Application Data

(60) Provisional application No. 62/750,296, filed on Oct. 25, 2018.

(51) Int. Cl.

| | |
|---|---|
| ***E04B 1/344*** | (2006.01) |
| ***E06B 5/10*** | (2006.01) |
| ***F41H 5/24*** | (2006.01) |
| ***F41H 5/06*** | (2006.01) |
| ***F41H 5/013*** | (2006.01) |

(52) U.S. Cl.
CPC ..... *E04B 1/344* (2013.01); *E06B 5/10* (2013.01); *F41H 5/013* (2013.01); *F41H 5/06* (2013.01); *F41H 5/24* (2013.01)

(58) Field of Classification Search
CPC ..... E04B 1/344; E04B 1/3445; E04B 2/7425; E04B 2/7427; E04B 2/7431; E04H 9/06; E04H 15/48; E06B 3/481; E06B 5/10; F41H 5/013; F41H 5/06; F41H 5/08; F41H 5/14; F41H 5/18; F41H 5/24
See application file for complete search history.

(56) References Cited

U.S. PATENT DOCUMENTS

| | | | | |
|---|---|---|---|---|
| 3,073,382 A * | 1/1963 | Zimmerman | ..... | E06B 3/481 160/183 |
| 3,232,333 A * | 2/1966 | Dixon | ..... | E06B 3/481 160/183 |
| 9,309,710 B2 | 4/2016 | Goodman et al. | | |
| 9,675,720 B2 * | 6/2017 | Romo | ..... | A61L 9/20 |
| 10,125,486 B1 * | 11/2018 | Handley | ..... | E04B 2/7427 |

(Continued)

FOREIGN PATENT DOCUMENTS

WO 2016199136 A1 12/2016

OTHER PUBLICATIONS

Oliva Smith and Elisa Tang, This 14-year-old inventor designed a bulletproof wall to protect students during school shootings, Aug. 13, 2018, Good Morning America, pp. 1-5. (Year: 2018).*

*Primary Examiner* — Jessie T Fonseca
(74) *Attorney, Agent, or Firm* — William H. Dippert; Laurence A. Greenberg; Werner H. Stemer

(57) ABSTRACT

A deployable indoor shelter is disclosed that comprises a deployable shelter that forms a safe zone. When the shelter is withdrawn, it occupies substantially undisturbed indoor space and when the deployable shelter is deployed, the safe zone is confined within at least one wall of the indoor space and the deployable shelter.

14 Claims, 7 Drawing Sheets

(56) References Cited

U.S. PATENT DOCUMENTS

| | | | | |
|---|---|---|---|---|
| 10,968,622 | B2 | 4/2021 | Klein | |
| 2011/0000625 | A1 | 1/2011 | George | |
| 2014/0216239 | A1* | 8/2014 | White | F41H 5/08 89/36.02 |
| 2016/0332718 | A1* | 11/2016 | Guering | B64C 1/1438 |
| 2017/0089122 | A1* | 3/2017 | Lewis | E06B 3/481 |
| 2020/0018572 | A1* | 1/2020 | Gonzales | F41H 5/24 |
| 2020/0248990 | A1* | 8/2020 | Larson | E04B 2/7425 |
| 2022/0106787 | A1* | 4/2022 | Levy | E04B 2/7427 |

* cited by examiner

DEPLOYABLE INDOOR SHELTER

CROSS-REFERENCE TO RELATED APPLICATIONS

This patent application is a U.S. National Phase filing under 35 U.S.C. § 371 of PCT Patent Application No. PCT/IB2019/059159, filed Oct. 25, 2019, which is based upon and claims the priority of U.S. Provisional Patent Application Ser. No. 62/750,296, filed Oct. 25, 2018, each of which is incorporated herein by reference in its entirety.

TECHNICAL FIELD

The present disclosed subject matter relates to sheltering people in urgent need. More particularly, the present disclosed subject matter relates to an indoor deployable shelter to be deployed in emergency situations.

BACKGROUND

Classrooms in schools, institutions, or universities can become a trap to children or people that are studying in the classroom when a hazard such as a shooter, as an example, is getting into the classroom or even shoots at the children from outside the classroom. Another example of an immediate danger is an earthquake. In order to prevent those life-threatening situations, schools or academic institutions use face recognition techniques to check who gets into the institution, a guard that can check people upon inserting the building. The guard can initiate an alarm, or shutdown of the doors. However, this cannot ensure the safety of the children or people that are present in classrooms when a shooter, as an example, gets into the class.

The problem is that the space of the classroom is not safe to the people inside and moreover, the classroom can become a real trap to the people or children inside. There are solutions that can assist the person that is captured within the classroom to protect himself by transforming furniture to a shelter. Such a solution is disclosed in U.S. Pat. No. 8,701,544 in which furniture in the classroom such as a table can be covered with bullet proof construction wherein the person can hold the table as a shield. This solution and similar ones can be used only as a shield for a single person that knows exactly where the fire comes from. There is a need for an effective and wholistic solution to all people in the classroom.

SUMMARY

It is an object of the present disclosure to provide an indoor shelter that is situated within the space of a classroom that is expendable and become effective when a threat appears suddenly.

It is another object of the present disclosure to provide a deployable shelter that doesn't disturb or almost doesn't disturb the space it is position within when the shelter is not operative.

It is therefore provided in accordance with a preferred embodiment, a deployable indoor shelter comprising a deployable shelter that forms a safe zone when deployed and substantially undisturbed indoor space when said deployable shelter is withdrawn, wherein in a deployed state, the safe zone is confined within at least one wall of the indoor space and the deployable shelter.

In accordance with another preferred embodiment, said at least one wall is an interior wall having no openings.

In accordance with another preferred embodiment, said deployable shelter comprises a plurality of sections connected to one another by hinges so that when the deployable shelter is in a withdrawn state, the sections are adjacent one another.

In accordance with another preferred embodiment, the hinges between the sections are configured to prevent open spaces between the sections when the shelter is deployed.

In accordance with another preferred embodiment, the hinges are provided with metal sheets that are provided to secure any gap formed between two adjacent sections so as to cover any spacing between the sections.

In accordance with another preferred embodiment, the plurality of sections 112 are made of a hard material such as metal, hard metal, or any other bullet proof material.

In accordance with another preferred embodiment, a height of the deployable shelter is substantially the same as a height of the indoor space.

In accordance with another preferred embodiment, the deployable shelter comprises wheels at the bottom.

In accordance with another preferred embodiment, one end of the deployable shelter is permanently anchored to a corner of the indoor space.

In accordance with another preferred embodiment, the deployable shelter comprises a shelter wall that expends the safe zone by moving between two parallel walls of the indoor space.

In accordance with another preferred embodiment, a pair of movable side shields are provided so as to allow the deployable shelter to move forward to within the indoor space.

In accordance with another preferred embodiment, each of the shields is made of at least two panels associated to each side of the shelter wall.

In accordance with another preferred embodiment, each end of the shelter wall 201 is connected by a hinge to one of the panels.

In accordance with another preferred embodiment, the panels and the shelter wall are made of metal and or any other bullet proof material.

In accordance with another preferred embodiment, the panels can be configured to be situated opposite an opening in said at least one wall.

In accordance with another preferred embodiment, said hinge serves as a pivot between the panels.

In accordance with another preferred embodiment, in order to withdraw the deployable shelter, the shelter wall is pushed against said at least one wall.

In accordance with another preferred embodiment, the panel are configured to swung against a nearest wall of indoor space.

In accordance with another preferred embodiment, the deployable shelter has a lock.

In accordance with another preferred embodiment, the deployable shelter is confined within a self-supported construction.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the drawings.

DETAILED DESCRIPTION

Figure 1:
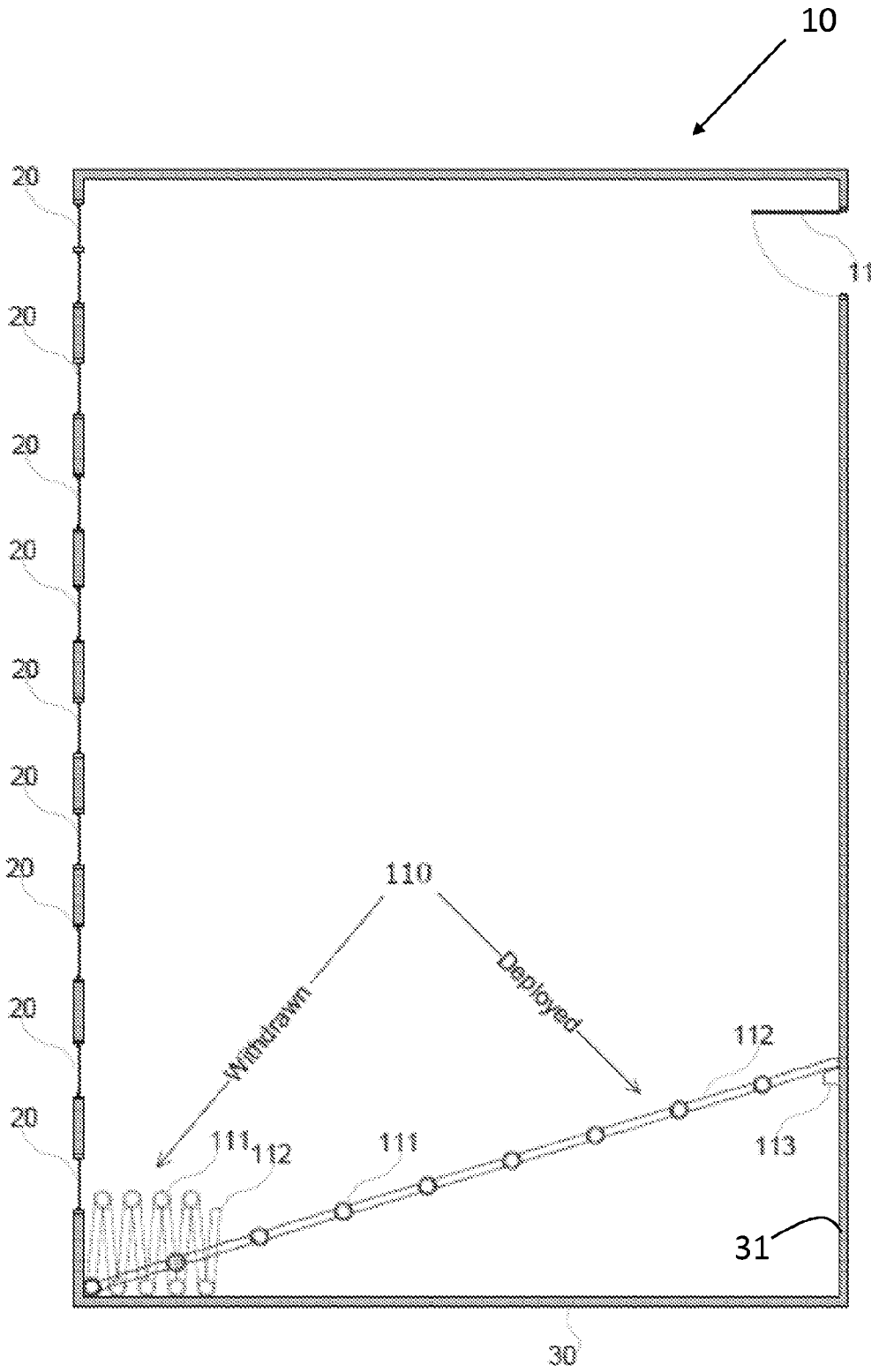
FIG. 1 schematically illustrates a deployable shelter in an indoor space, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The terms "comprises", "comprising", "includes", "including", and "having" together with their conjugates mean "including but not limited to". The term "consisting of" has the same meaning as "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this disclosed subject matter may be presented in a range format. It should be understood that the description in range format is merely for convenience and brevity and should not be construed as an inflexible limitation on the scope of the disclosed subject matter. Accordingly, the description of a range should be considered to have specifically disclosed all the possible sub-ranges as well as individual numerical values within that range.

It is appreciated that certain features of the disclosed subject matter, which are, for clarity, described in the context of separate embodiments, may also be provided in combination in a single embodiment. Conversely, various features of the disclosed subject matter, which are, for brevity, described in the context of a single embodiment, may also be provided separately or in any suitable sub-combination or as suitable in any other described embodiment of the disclosed subject matter. Certain features described in the context of various embodiments are not to be considered essential features of those embodiments, unless the embodiment is inoperative without those elements.

Referring now to FIG. 1, schematically illustrating a deployable indoor shelter in an indoor space, in accordance with some exemplary embodiments of the disclosed subject matter.

A deployable shelter 110 is provided within an indoor space 10 provided with at least one wall with openings such as windows 20 and a door 11 usually at an interior wall. The deployable shelter 110 is illustrated in the figure in a withdrawn state in broken lines and in a deployed state in solid lines. In the withdrawn state, the shelter occupies a small space within the indoor space 10 wherein this space is a minimal space that will not disturb any activity in the space. In the deployed state, the shelter 110 uses a part of the indoor space as a safe zone that is confined partially by the walls of the indoor space and partially by the deployable shelter.

In some exemplary embodiments, shelter 110 comprises a plurality of sections 112 connected to one another by hinges 111 in such a way that enables quick deployment, i.e. opening; stretching; unfolding; or the like, of shelter 110 between two walls of space 10, and preferably between two parallel walls, at least one of which doesn't have windows. Thereby forming a sheltered perimeter, bounded by the deployed shelter 110 itself, back-wall 30 having no windows, and a portion of a side wall perpendicular to the back-wall 30 having no windows as well, that can accommodate and protect people in an event of shooting and or explosive attack. When the shelter 110 is withdrawn, the sections are adjacent to one another as shown in the broken lines in the figure.

It should be mentioned that the hinges between the sections are such that don't allow any open spaces between the sections that may impair the stability and durability of the shelter 110 when attacked.

Figure 2:
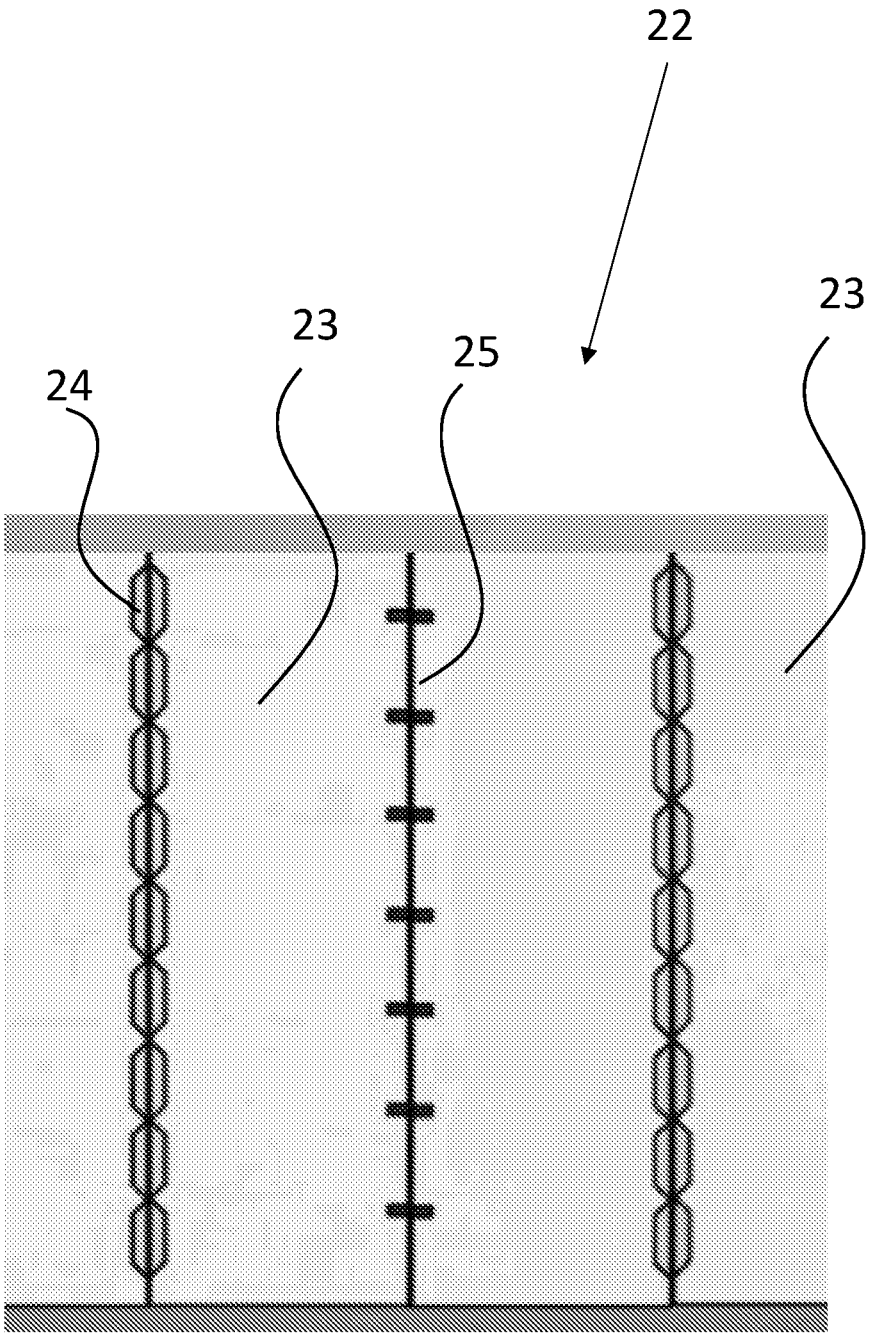
FIG. 2 schematically illustrates a frontal view of deployable shelter in a deployed state, in accordance with some exemplary embodiments of the disclosed subject matter.

Reference is now made to FIG. 2 illustrating a frontal view of deployable shelter in a deployed state, in accordance with some exemplary embodiments of the disclosed subject matter. The deployable shelter 22 comprises sections 23 connected through hinges 24 or 25. In the case of hinges 24, the hinges are provided with metal sheets that are provided on the spacing that may be formed between two adjacent sections so as to cover any gap formed between the sections and prevent any material, ricochets, debris or the same pass through the shelter. In the case of hinge 25, the hinges are adapted to keep the sections fully adjacent to each other.

Returning to FIG. 1: in some exemplary embodiments, sections 112 are made of metal or hard metal and/or any other bullet proof material. The bottom of each section may comprise wheels (not shown in the figure) to facilitate opening shelter 110, to the deployed state, and closing it back to the withdrawn state. The sections 112 may be as high as the space 10 height, however not necessarily and it is possible that clearing sprinklers are mounted on a ceiling of space 10 and also a relatively small space between the ceiling and the sections or a portion of them is kept allowing for airflow between the ceiling and the top of the sections.

In some exemplary embodiments, one end of the shelter 110 can be permanently anchored to one of the walls in a spot situated between a corner with back-wall and the nearest window, so that the sheltered perimeter will not have a window. Normally, shelter 110 can be stowed (folded) into a withdrawn state in such a way that occupies minimal space.

In an event of attack, shelter 110 can be deployed by unfolding while stretching the shelter 110 to an opposite wall after gathering all the people (occupants) into the sheltered perimeter. In some exemplary embodiments, shelter 110 may comprise a lock 113 that can be locked from inside the sheltered perimeter.

Figure 3:
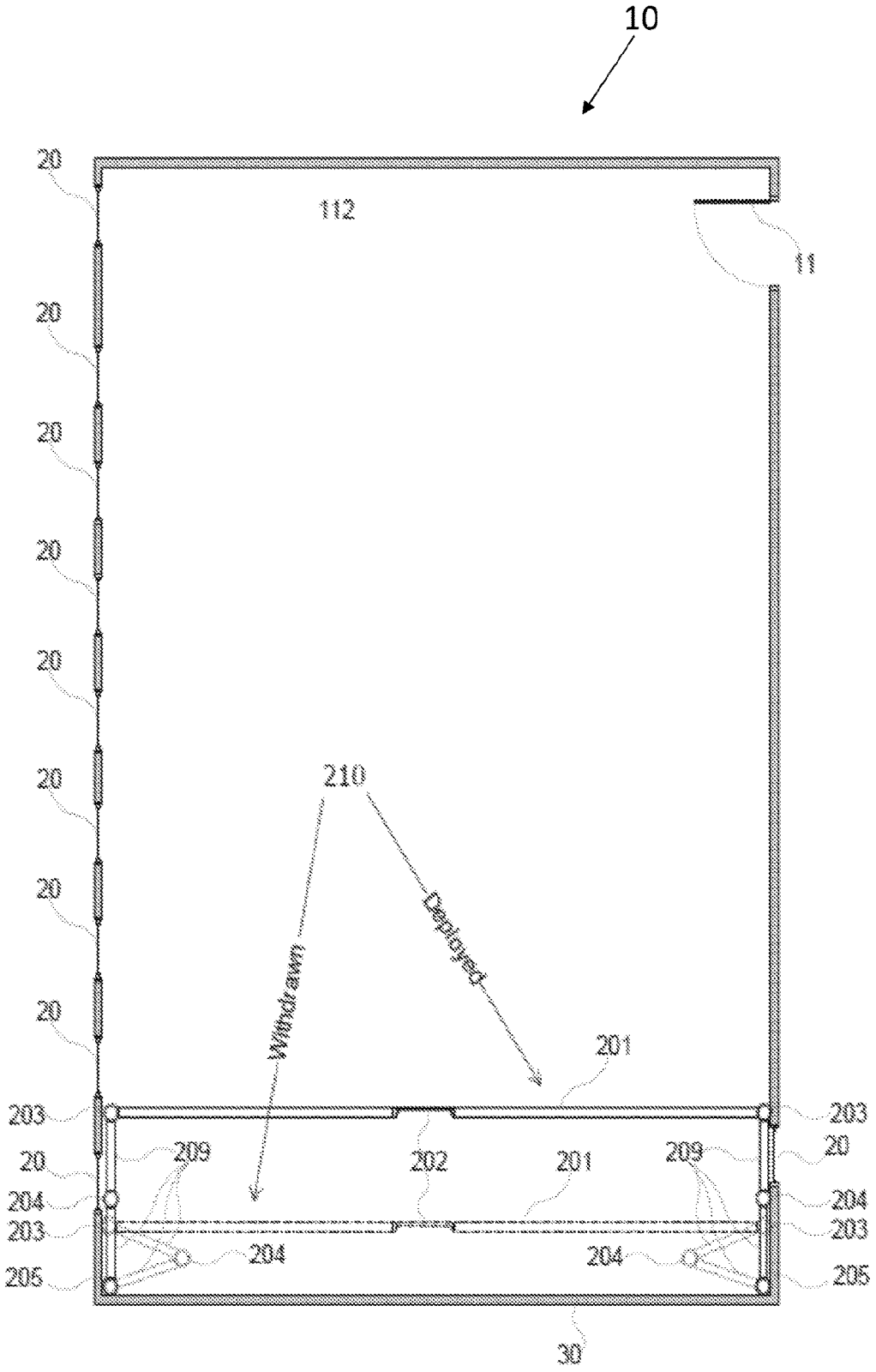
FIG. 3 schematically illustrates another deployable shelter in an indoor space, in accordance with some exemplary embodiments of the disclosed subject matter.

Referring now to FIG. 3, schematically illustrating a deployable shelter in an indoor space, in accordance with some exemplary embodiments of the disclosed subject matter. The deployable shelter 210 is illustrated within the indoor space 10 having at least one exterior wall with windows 20 and a door 11 in an interior wall in a withdrawn state illustrated in broken lines and in a deployed state illustrated in solid lines.

In some exemplary embodiments, shelter 210 comprises a shelter wall 201 that is expended between two parallel walls of space 10 by moving towards the indoor space and a pair of side shields each made of at least two panels 209 associated to each side of wall 201. Each end of the shelter wall 201 is connected by hinge 203 to a panel 209 of the side shield. In some exemplary embodiments, the at least two panels 209 of each side shield can be connected to one another by hinge 204 and the ends of panels 209 that are situated next to the back-wall can be permanently anchored by hinge 205 to back-wall 30. The distance between the two hinges 205 and the distance between the two hinges 203 is preferably equal.

In some exemplary embodiments, panels 209 and wall 201 can be made of metal and or any other bullet proof material. Additionally, or alternatively, wall 201 can comprise at least one door 202 also made of metal and/or any other bullet proof material.

In the withdrawn state, illustrated in broken lines, shelter 210 can be pushed against back-wall 30, wherein the at least two panels 209 of each side shield folds inwardly in a scissors like motion while hinge 204 serves as their pivot. In order to deploy the shelter 210 from the withdrawn state into the deployed state, wall 201 is pulled away from back-wall 30 until panels 209 of both sides shields are perpendicular to both the backwall 30 and wall 201.

In some exemplary embodiments, the bottom of each panel 209 as well as the bottom of wall 201 comprise wheels (the wheels are not shown in the figure) to facilitate pulling/pushing shelter 210, to a deployed state, and closing it back to the withdrawn state. Panels 209 and wall 201 can be as high as the height of space 10, however clearing sprinklers mounted on the ceiling of space 10 can be placed between the ceiling and the wall of the shelter, allowing airflow between the ceiling and the top of the wall.

It should be noted that upon deploying shelter 210, a sheltered perimeter, which can accommodate and protect people in shooting/explosion event, can be formed. In some exemplary embodiments, the sheltered perimeter is bounded by the at least two panels 209 of each side, back-wall 30 and wall 201, where panels 209 shields the occupants, of the shielded perimeter, from attacks initiated from windows 20 and wall 201 shields the occupants from attacks initiated from door 11 or inside space 10.

In some exemplary embodiments, shelter 210 can be locked from inside the sheltered perimeter after gathering all the occupants inside the shielded/sheltered perimeter. Additionally, or alternatively, shelter 210 can comprise a motorized mechanism, adapted to facilitate, i.e. power & speed-up, the deployment and the withdrawal of shelter 210.

It will be noted that, space 10 can be an indoor space design to accommodate people, such as a classroom; a church; any house for worship; a bank, a kindergarten; a club; a shop; a studio; a restaurant; and any combination thereof, or the like.

Figure 4:
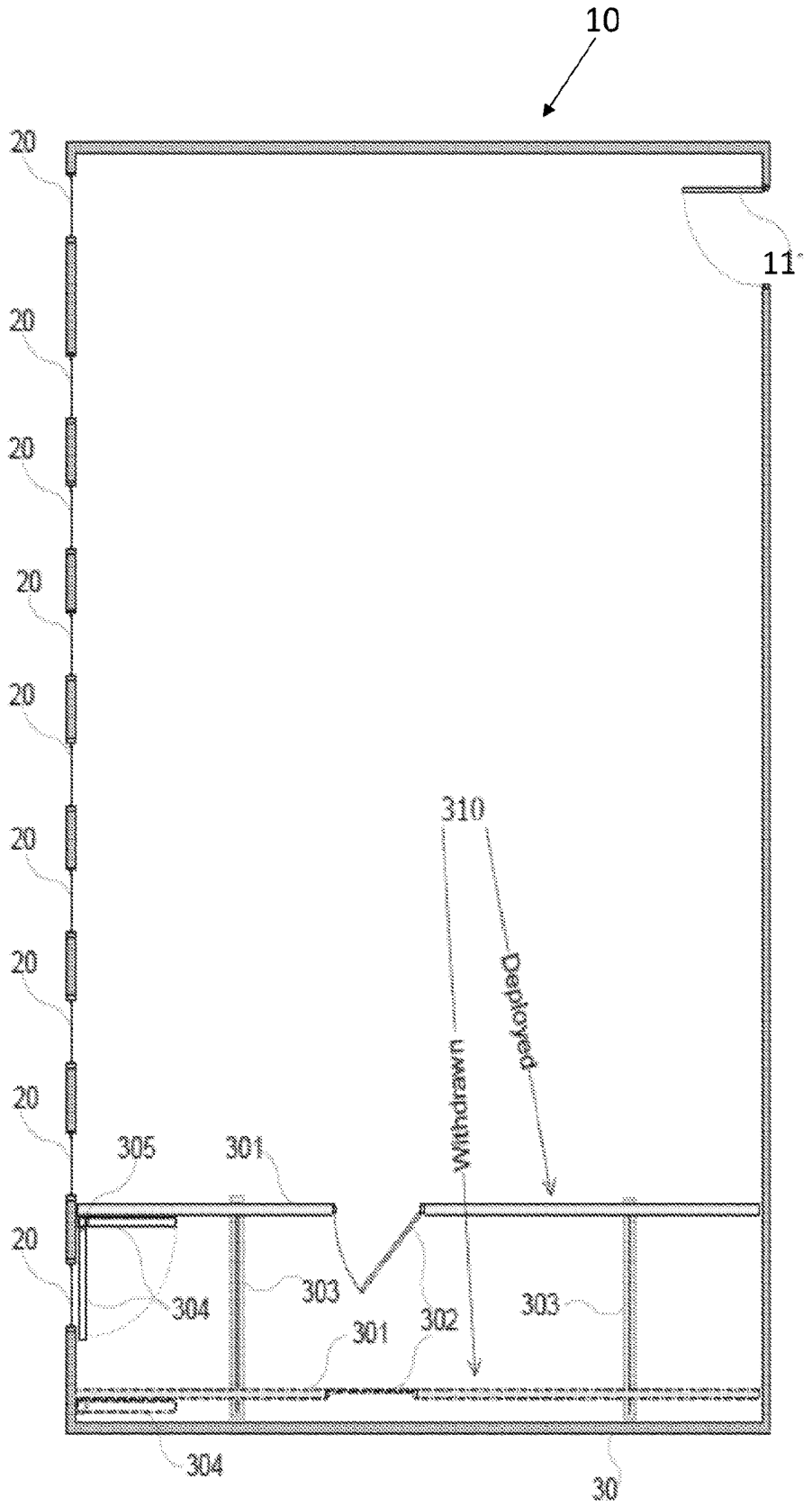
FIG. 4 schematically illustrates yet another deployable shelter in an indoor space, in accordance with some exemplary embodiments of the disclosed subject matter.

Referring now to FIG. 4, schematically illustrating a deployable shelter in an indoor space, in accordance with some exemplary embodiments of the disclosed subject matter. The deployable shelter 310, is positioned within a space 10 illustrated in a withdrawn state in broken lines and in a deployed state in solid lines.

In some exemplary embodiments, shelter 310 comprises a shelter wall 301 that stretches between two parallel walls of space 10 by forward movement. It is preferable that at least one panel 304 is provided. At least one door 302 is provided so as to allow children to enter the safe zone. It will be noted that, the shelter wall 301, the at least one panel 304 and the at least one door 302 can be similar or identical to wall 201, panel 209 and door 202 of FIG. 3, respectively.

In the withdrawn state, illustrated in broken lines, shelter 310 is pushed against back-wall 30, while the at least one panel 304 is swung against wall 301. In order to deploy the shelter 310 from the withdrawn state to the deployed state, wall 301 is pulled away from back-wall 30 along an entire length of at least two tracks 303. Additionally, panel 304 can be swung against the nearest wall of space 10 in order to cover window 20.

Similar to wall 201 shown in FIG. 2, the bottom of wall 301 may be equipped with wheels to facilitate pulling/pushing shelter 310 to a deployed state, and closing it back to the withdrawn state. Panel 304 and wall 201 can be as high as the height of space 10, however clearing sprinklers mounted on the ceiling of space 10 can be positioned within a space between the ceiling and the wall, this will allow airflow between the ceiling and the top of the wall.

It should be noted that upon deploying shelter 310, a sheltered perimeter, which can accommodate and protect people in a shooting/explosion event, may be formed. In some exemplary embodiments, the sheltered perimeter is bounded by the at least one panel 209, the two parallel walls, back-wall 30 and wall 301. In such embodiments, panel 304 shields the occupants, of the shielded perimeter, from attacks initiated from windows 20 and wall 301 shields the occupants from attacks initiated from door 11 or inside space 10.

In some exemplary embodiments, shelter 310 can be locked from inside the sheltered perimeter after gathering all the occupants inside the shielded/sheltered perimeter. Additionally, or alternatively, shelter 310 can comprise a motorized mechanism, adapted to facilitate, i.e. power & speed-up, the deployment and the withdrawal of shelter 310.

Figure 5:
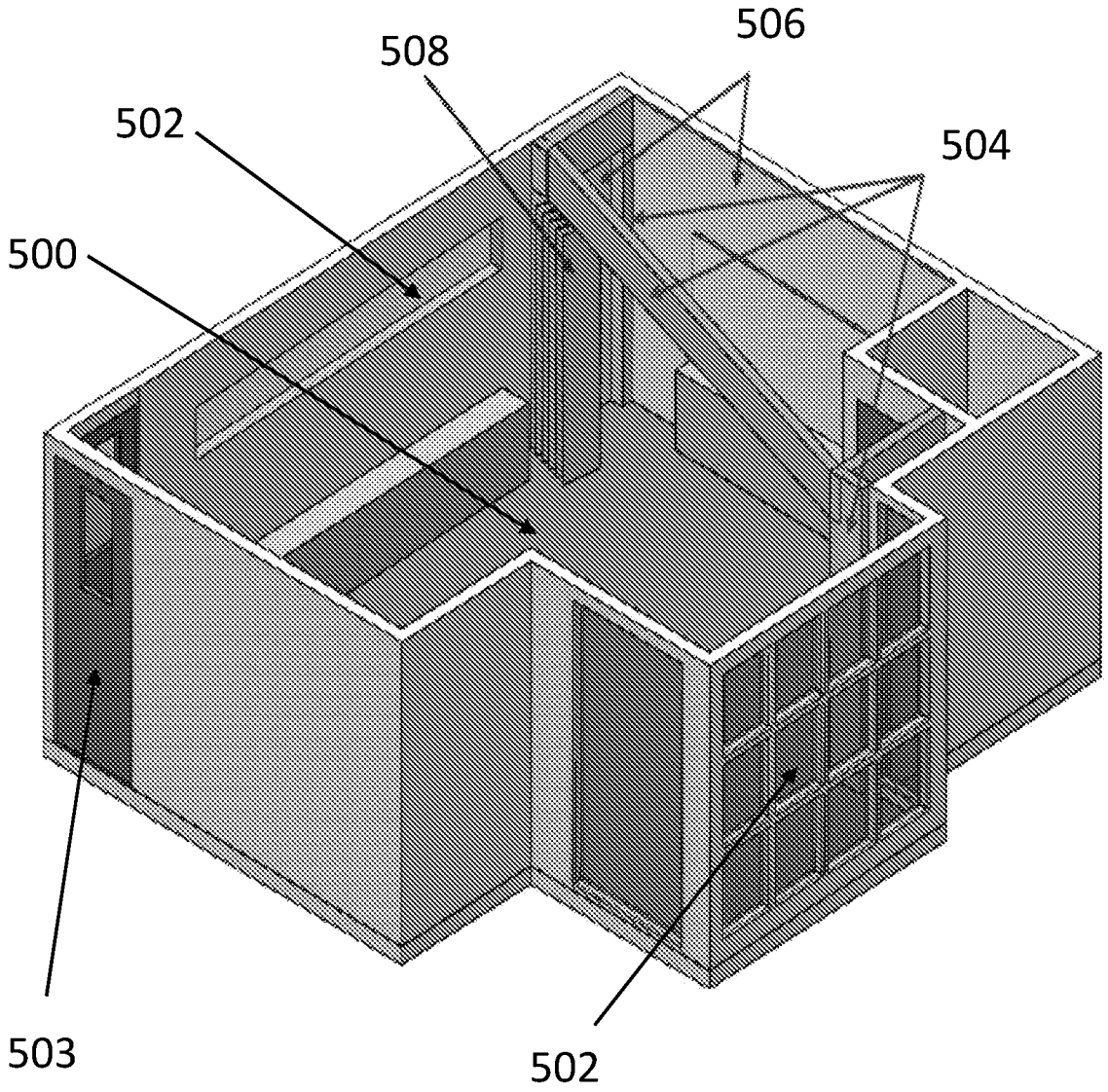
FIG. 5 schematically illustrates a classroom provided with a construction configured to confine a safe zone within the classroom, in accordance with some exemplary embodiments of the disclosed subject matter.

Reference is now made to FIG. 5 illustrating a classroom provided with a construction configured to confine a safe zone within the classroom, in accordance with some exemplary embodiments of the disclosed subject matter. Classroom 500 has several walls, some of them are having windows 502 and some are not. A door 503 is also provided on one of the walls.

A self-supported construction 504 configured to confine the safe zone of the classroom is provided on walls 506 that preferably have no windows. A folded shield 508 is provided beneath a portion of the construction 504 wherein in the folded or withdrawn state as shown in the figure, the construction as well as the shield are occupying minimal space of the classroom 500.

Figure 6A:
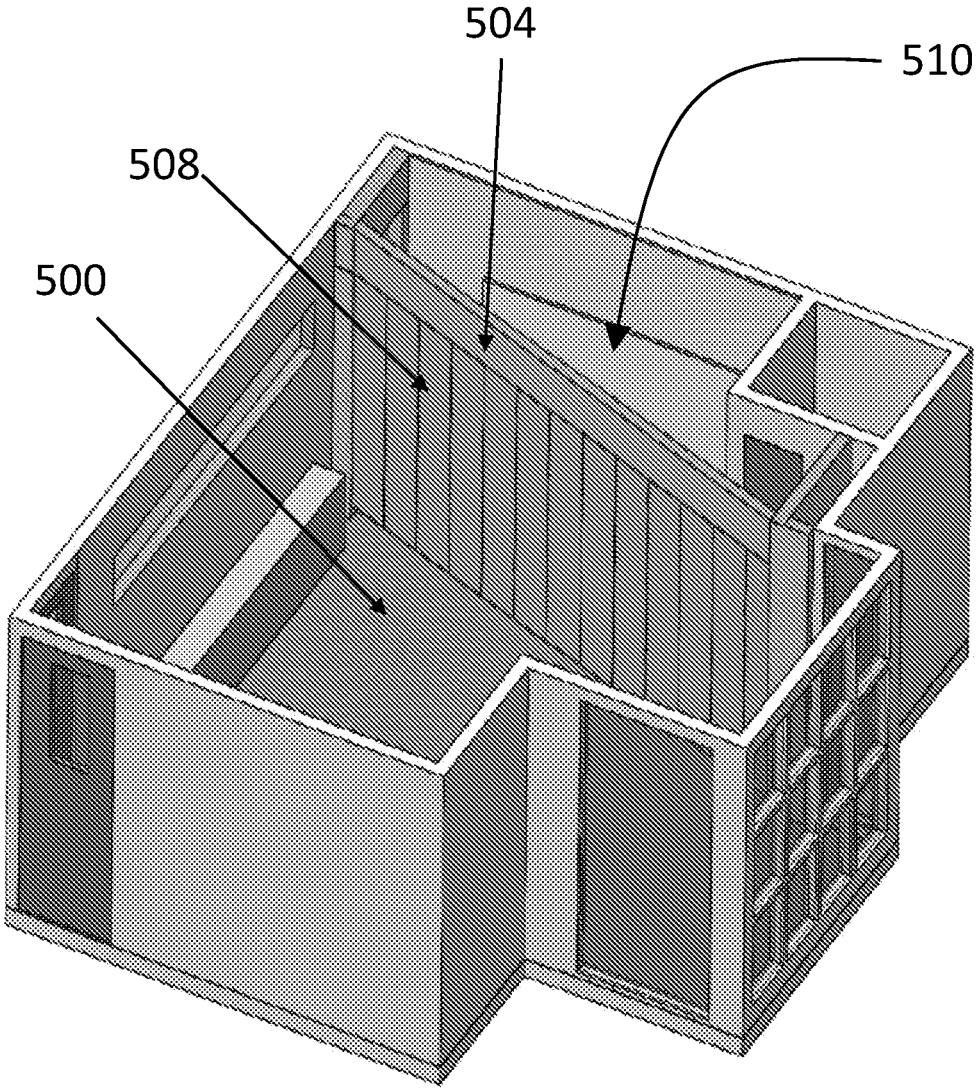
FIG. 6A schematically illustrates the classroom shown in FIG. 5, with the safe zone in a deployed state.

Reference is now made to FIG. 6A schematically illustrating the classroom shown in FIG. 5, with the safe zone in a deployed state. As mentioned herein before, in case of danger, the children in the classroom, are gathered within a confined and safe zone in classroom 500. The shield 508 is deployed manually or automatically beneath a portion of construction 504 so as to close an indoor shelter area 510. The shield can be similar to the sections shown in FIG. 1, however, can be any other type of curtain-like foldable wall.

Figure 6B:
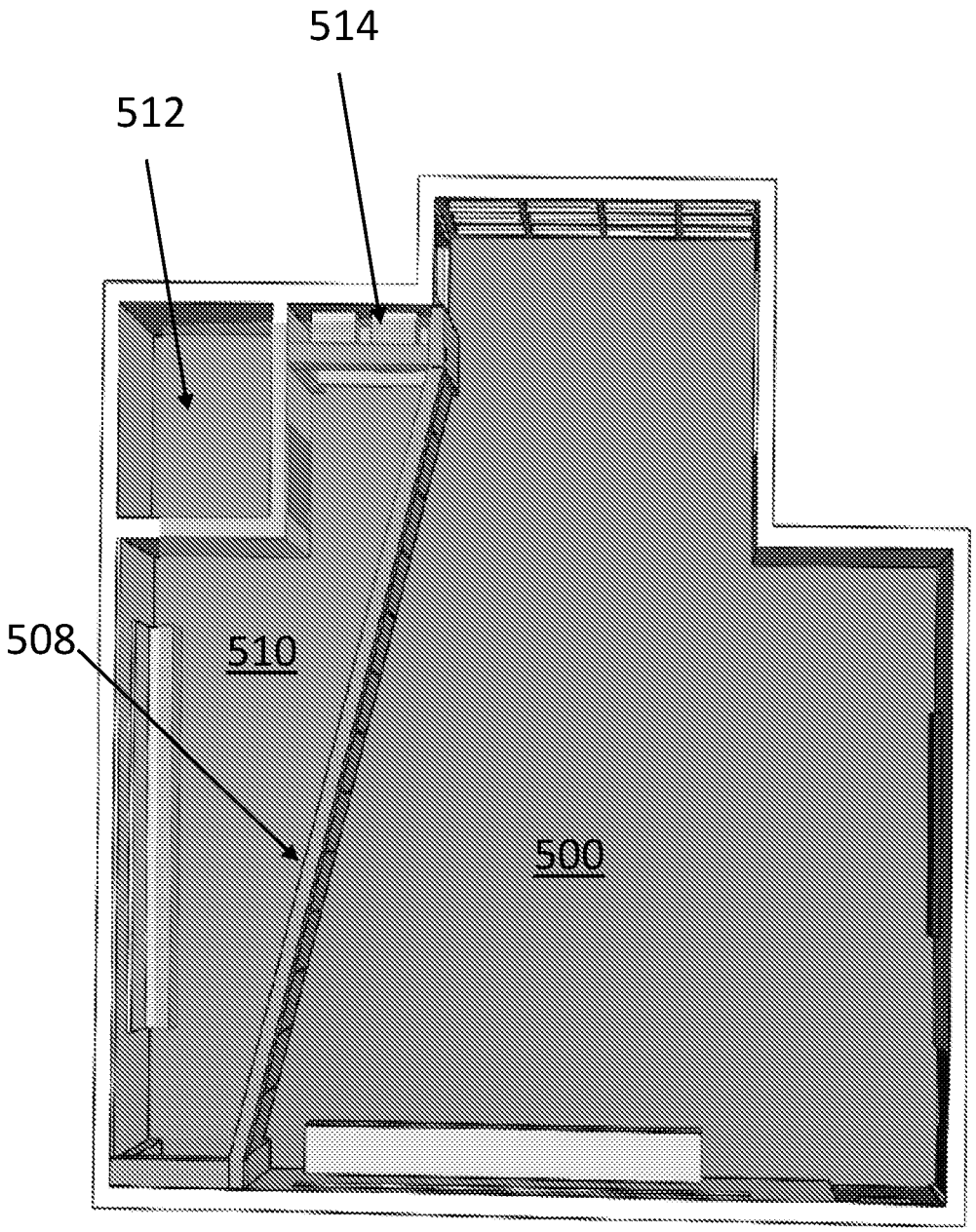
FIG. 6B illustrates a top view of the classroom shown in FIG. 5, with the safe zone in a deployed state.

Reference is now made to FIG. 6B illustrating a top view of the classroom shown in FIG. 5, with the safe zone in a deployed state. This figure clearly illustrates the separation between the classroom 500 that should be vacant during attack and the safe zone 510 that is separated from the rest of the classroom by shield 508. It is possible to add to the area of the safe zone a toilet room 512 and a sink 514 with running water so as to allow a group of people to be confined within the safe zone area for some time, especially when children are involved.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. An indoor shelter to be deployed within an indoor space comprising a plurality of sections connected to one another by hinges that are configured to prevent open spaces between the sections when the indoor shelter is deployed, and at least one wall of the indoor space wherein the indoor shelter forms a safe zone when the plurality of sections are deployed while occupying substantially undisturbed indoor space when the plurality of sections are withdrawn, wherein in a deployed state, the indoor shelter is confined within the indoor space between the plurality of sections in their deployed state and said at least one wall forms a sheltered perimeter that is bounded from all sides, wherein at least one of the plurality of sections is parallel to the at least one wall of the indoor space at both the deployed state or when withdrawn and wherein the at least one of the plurality of sections that is parallel to the at least one wall is oppositely movable so as to expand the safe zone of the indoor space.

2. The indoor shelter of claim 1, wherein said at least one wall is an interior wall having no openings.

3. The indoor shelter of claim 1, wherein when the indoor shelter is in a withdrawn state, the sections are substantially parallel and adjacent one another.

4. The indoor shelter of claim 1, wherein the hinges are provided with metal sheets that are provided to secure any gap formed between two adjacent sections to cover any spacing between the sections.

5. The indoor shelter of claim 1, wherein the plurality of sections is made of a hard material selected from the group consisting of metal, hard metal, and any other bullet-proof material.

6. The indoor shelter of claim 1, wherein a height of the indoor shelter is substantially the same as a height of the indoor space.

7. The indoor shelter of claim 1, wherein the indoor shelter comprises wheels at a bottom of the indoor shelter.

8. The indoor shelter of claim 1, wherein a pair of hinged sections of the plurality of sections is provided on both opposing sides of the at least one wall to allow the indoor shelter to move forward to within the indoor space.

9. The indoor shelter of claim 8, wherein an end of the pair of hinged sections is connected by a hinge to one end of at least one wall.

10. The indoor shelter of claim 8, wherein the pair of hinged sections are made of metal, any other bullet-proof material, or metal and any other bullet-proof material.

11. The indoor shelter of claim 8, wherein the pair of hinged sections can be configured to be situated opposite an opening in said at least one wall.

12. The deployable indoor shelter of claim 1, wherein to withdraw the indoor shelter, the at least one of the plurality of sections that is parallel to said at least one wall is pushed against said at least one wall.

13. The indoor shelter of claim 1, wherein the indoor shelter has a lock that can be locked from inside the safe zone.

14. The indoor shelter of claim 1, wherein the indoor shelter is confined within a self-supported construction.

* * * * *